United States Patent [19]

Baba

[11] Patent Number: 4,503,969

[45] Date of Patent: Mar. 12, 1985

[54] DEVICE FOR SPLITTING A PAIR OF SEGMENTED TRANSFER BARS OF A TRANSFER PRESS OR THE LIKE

[75] Inventor: Kiyokazu Baba, Komatsu, Japan

[73] Assignee: Kabushiki Kaisha Komatsu Seisakusho, Tokyo, Japan

[21] Appl. No.: 509,015

[22] Filed: Jun. 28, 1983

[30] Foreign Application Priority Data

Jul. 2, 1982 [JP] Japan ..... 57-099246[U]
Jul. 2, 1982 [JP] Japan ..... 57-099249[U]

[51] Int. Cl.[3] ..... B65G 25/00; B65G 37/00

[52] U.S. Cl. ..... 198/621; 414/750; 414/751; 414/225

[58] Field of Search ..... 198/740, 621, 488, 648, 198/774; 414/222, 225, 750, 751; 83/405; 29/33 P, 563

[56] References Cited

U.S. PATENT DOCUMENTS 4,329,866 5/1982 Babbitt ..... 414/751

FOREIGN PATENT DOCUMENTS 54-108075 8/1979 Japan .
0108076 8/1979 Japan ..... 198/774

*Primary Examiner*—Joseph E. Valenza
*Assistant Examiner*—Douglas C. Voorhees
*Attorney, Agent, or Firm*—Frost & Jacobs

[57] ABSTRACT

A transfer press is disclosed which has a pair of parallel spaced transfer bars for indexing work through a succession of press stations. Each transfer bar consists of, typically, five segments separably joined end to end. For longitudinally moving the constituent segments of each transfer bar away from one another, as for the change of press dies, there are provided a one-way splitting mechanism which moves a terminal segment of each transfer bar away from the next, and a two-way splitting mechanism which separates the central segment of each transfer bar away from the oppositely adjoining ones. The one-way and two-way splitting mechanisms are approximately analogous in construction, each having a splitter pin which is movable up and down into and out of engagement with the desired transfer bar segment and which is further movable with the transfer bar segment for separating it from the neighboring segment or segments. The one-way splitting mechanism incorporates a dual cylinder assembly, and the two-way splitting mechanism a triple cylinder assembly, for moving the splitter pin as above. Additional embodiments are disclosed wherein each transfer bar is split into three and seven segments respectively.

7 Claims, 30 Drawing Figures

DEVICE FOR SPLITTING A PAIR OF SEGMENTED TRANSFER BARS OF A TRANSFER PRESS OR THE LIKE

BACKGROUND OF THE INVENTION

This invention relates to a transfer press or like apparatus having a pair of transfer bars extending in parallel spaced relation to each other for transporting work through one or more processing stations. More specifically the invention is directed to a device in such apparatus for splitting each transfer bar into a required number of segments as for the change of press dies.

As is well known, the transfer press is a streamlined machine having a series of press stations for continuously processing flat work into a variety of panel products such as those used for roofing, flooring, and doors. The pair of transfer bars in question are usually reciprocated longitudinally and further moved up and down and toward and away from each other for transporting work through the successive press stations as well as into and out of the machine. These transfer bars have given rise to a problem in changing the press dies.

On either side of the pair of transfer bars there are permanently installed two or more columns or uprights extending between the bed and crown of the machine. Being longer than the distance between the columns on either side, the transfer bars cannot possibly be moved sideways out of the press together with the dies on a movable bolster. It has therefore been suggested to split each transfer bar into, for instance, three segments if there are two uprights on each side. For die change the two terminal segments of each bar are longitudinally moved away from the central one, and then the pair of central segments are withdrawn from the press together with the dies on the bolster.

A variety of devices have also been suggested and used for longitudinally separating the transfer bar segments from one another. Most of such conventional devices are unsatisfactory, however, because of the complexity and expensiveness of construction, unreliability of operation, and/or lack of adaptability to transfer bars having different numbers of segments.

SUMMARY OF THE INVENTION

The present invention makes possible the splitting of the segmented transfer bars in apparatus of the kind specified, by means that are simplified in construction, positive and reliable in operation. The splitting device in accordance with the invention is also notable for its ready adaptability to transfer bars that must be split into different numbers of segments.

Basically the invention provides a splitting mechanism for longitudinally separating one transfer bar segment away from another, comprising a carriage disposed under one transfer bar segment and movable in its longitudinal direction along guide means. A splitter pin is mounted on the carriage for up and down motion relative to the same and for joint movement therewith along the guide means. When moved upwardly, the splitter pin engages the one transfer bar segment for joint movement therewith along the guide means. Supported under the guide means for pivotal motion about a fixed axis is at least one lever having a slot formed longitudinally therein for slidably receiving a slider which is mounted to the splitter pin for joint up and down motion therewith relative to the carriage and for joint movement with the splitter pin and the carriage along the guide means. A spring or like resilient means acts between the slider and the lever for biasing the slider away from the lever axis, so that the pivotal motion of the lever results in the up and down motion of the splitter pin relative to the carriage and also in the linear motion of the splitter pin and carriage along the guide means. The desired pivotal motion of the lever in a controlled manner is effected by a multiple cylinder assembly via a rack and pinion mechanism. Also included are cam means for holding the splitter pin in engagement with the transfer bar segment during the travel thereof along the guide means.

The multiple cylinder assembly can take two different forms depending upon its intended use. One of these is a dual cylinder assembly, which is essentially a combination of two fluid actuated cylinders in series. The oher is a triple cylinder assembly, a combination of three fluid actuated cylinders in series.

The splitting mechanism when equipped with the dual cylinder assembly finds use in unidirectionally separating a transfer bar segment from another. When provided with the triple cylinder assembly, on the other hand, the splitting mechanism can bidirectionally move a transfer bar segment away from the oppositely adjoining ones. Various combinations of such one-way and two-way splitting mechanisms, each constructed as in the foregoing and incorporating either a dual or triple cylinder assembly, lend themselves to use with pairs of transfer bars that are to be split into any required number of segments.

The above and other features and advantages of this invention and the manner of attaining them will become more apparent, and the invention itself will best be understood, from a study of the following description and appended claims, with reference had to the attached drawings showing some preferable embodiments of the invention.

DESCRIPTION OF THE PREFERRED EMBODIMENTS

Figure 1:
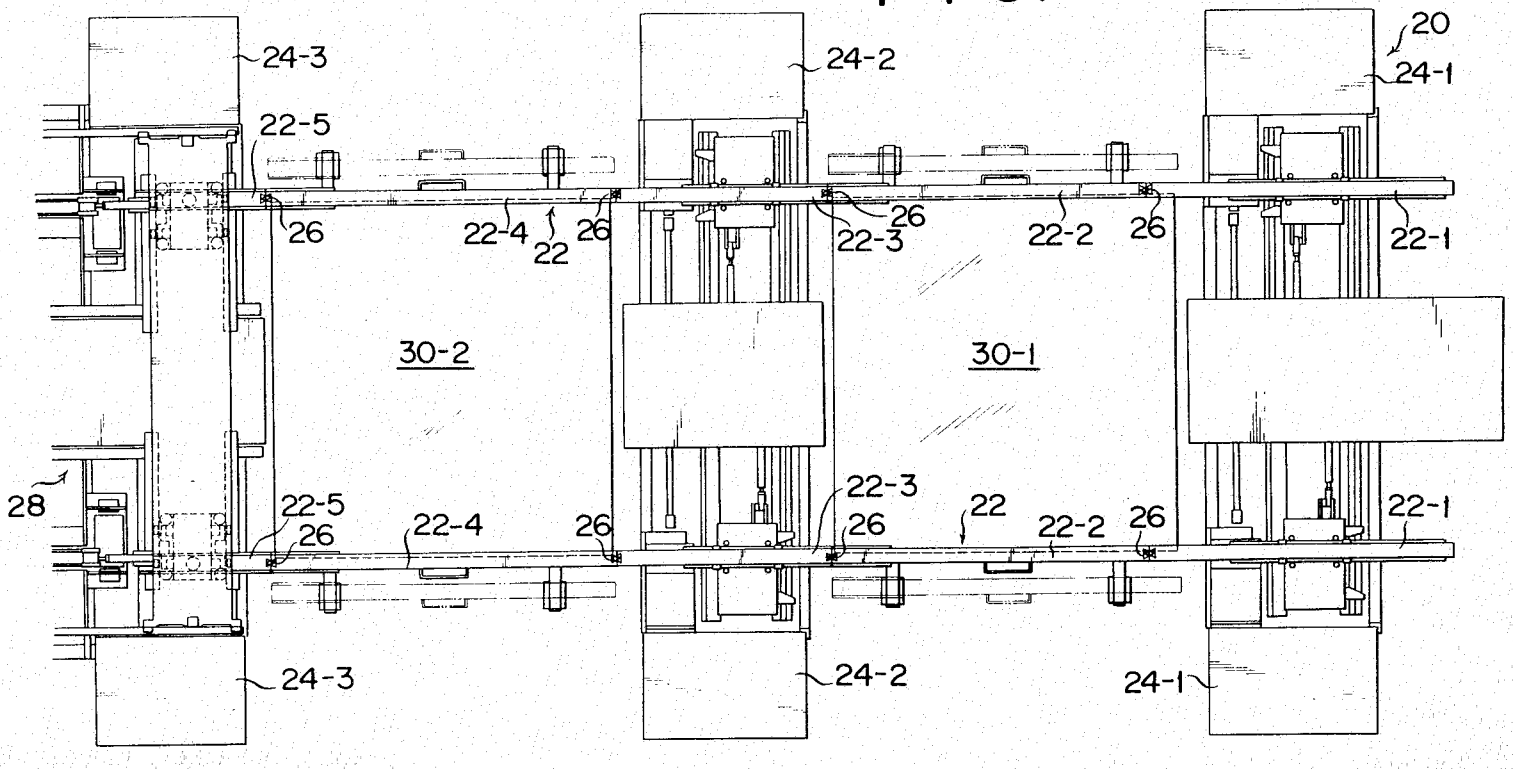
FIG. 1 is a diagrammatic plan of an example of transfer press having a pair of five-segment transfer bars to be split by the one-way and two-way splitting mechanisms in accordance with the invention.
Figure 2:
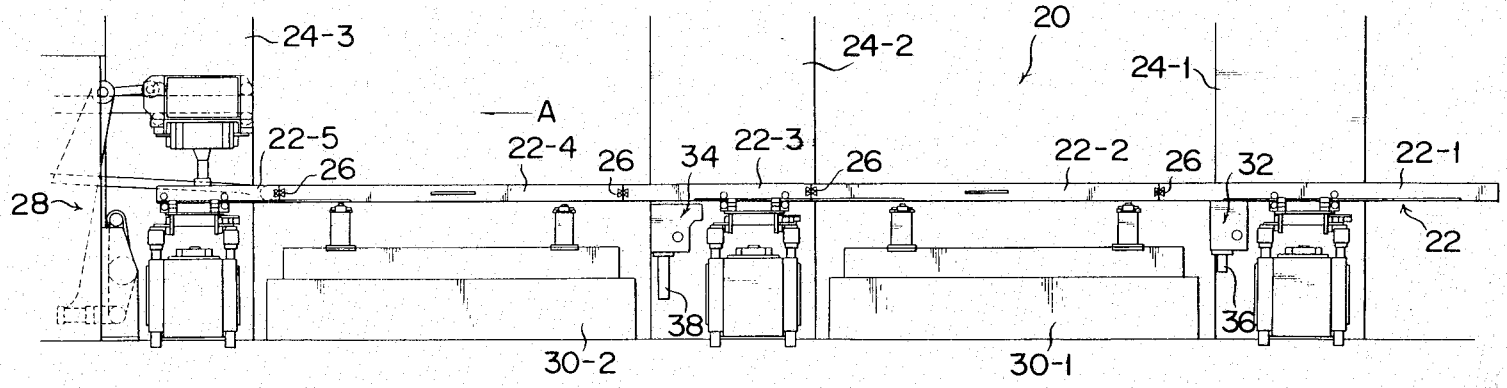
FIG. 2 is a side elevation of the transfer press of FIG. 1.

FIGS. 1 and 2 are both explanatory of the general organization of the exemplified transfer press, generally designated 20, with a pair of five-segment transfer bars 22 and three opposed pairs of uprights 24-1, 24-2 and 24-3. Extending horizontally in parallel spaced relation to each other, the pair of transfer bars 22 each consist of five segments 22-1, 22-2, 22-3, 22-4 and 22-5. These bar segments are normally separably joined end to end by couplings 26 of any known or suitable type. The three pairs of uprights 24-1 through 24-3 are immovably installed on both sides of the transfer bars 22.

At the left hand end of the transfer bar pair is a multiple drive mechanism 28 of conventional design for moving the transfer bars back and forth, up and down, and toward and away from each other. By the repetition of these motions in a prescribed sequence the transfer bars act to grip, lift, and transport successive workpieces from one press station to the next in the direction indicated by the arrow A in FIG. 2.

It will also be observed from FIGS. 1 and 2 that the two endmost (first and second) pairs of transfer bar segments 22-1 and 22-5 and the central (third) pair of bar segments 22-3 lie between the three opposed pairs of uprights 24-1 through 24-3. The second 22-2 and fourth 22-4 pairs of bar segments are shorter than the spacings between the respective pairs of uprights 24-1 through 24-3. For die change the five segments of each transfer bar 22 are disconnected by releasing the couplings 26 and are longitudinally split from one another. Then the second 22-2 and fourth 22-4 pairs of bar segments are withdrawn, together with respective die bolsters 30-1 and 30-2 on which they rest, from the press through the spaces between the three pairs of uprights 24-1 through 24-3.

FIG. 2 further reveals a one-way splitting mechanism 32 for separating the first (terminal) segment 22-1 of each transfer bar from the second 22-2, and a two-way splitting mechanism 34 for separating the third (central) segment 22-3 of each transfer bar from the second 22-2 and fourth 22-4. The fifth segment 22-5 can be separated from the fourth 22-4 by the multiple drive mechanism 28, although another one-way splitting mechanism could be employed to this end. As will become apparent as the description progresses, the one-way 32 and two-way 34 splitting mechanisms are analogous (not exactly alike) in construction except for a dual cylinder assembly 36 included in the former and a triple cylinder assembly 38 in the latter.

Figure 3:
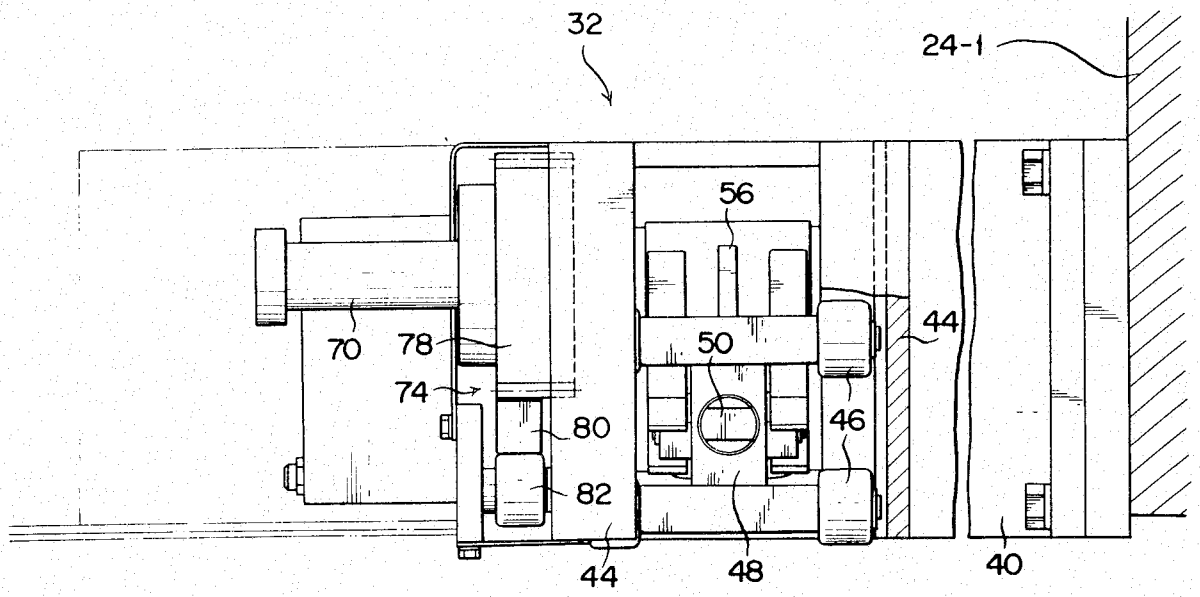
FIG. 3 is an enlarged plan, partly broken away for clarity, of one of the one-way splitting mechanisms used in the transfer press of FIGS. 1 and 2.
Figure 4:
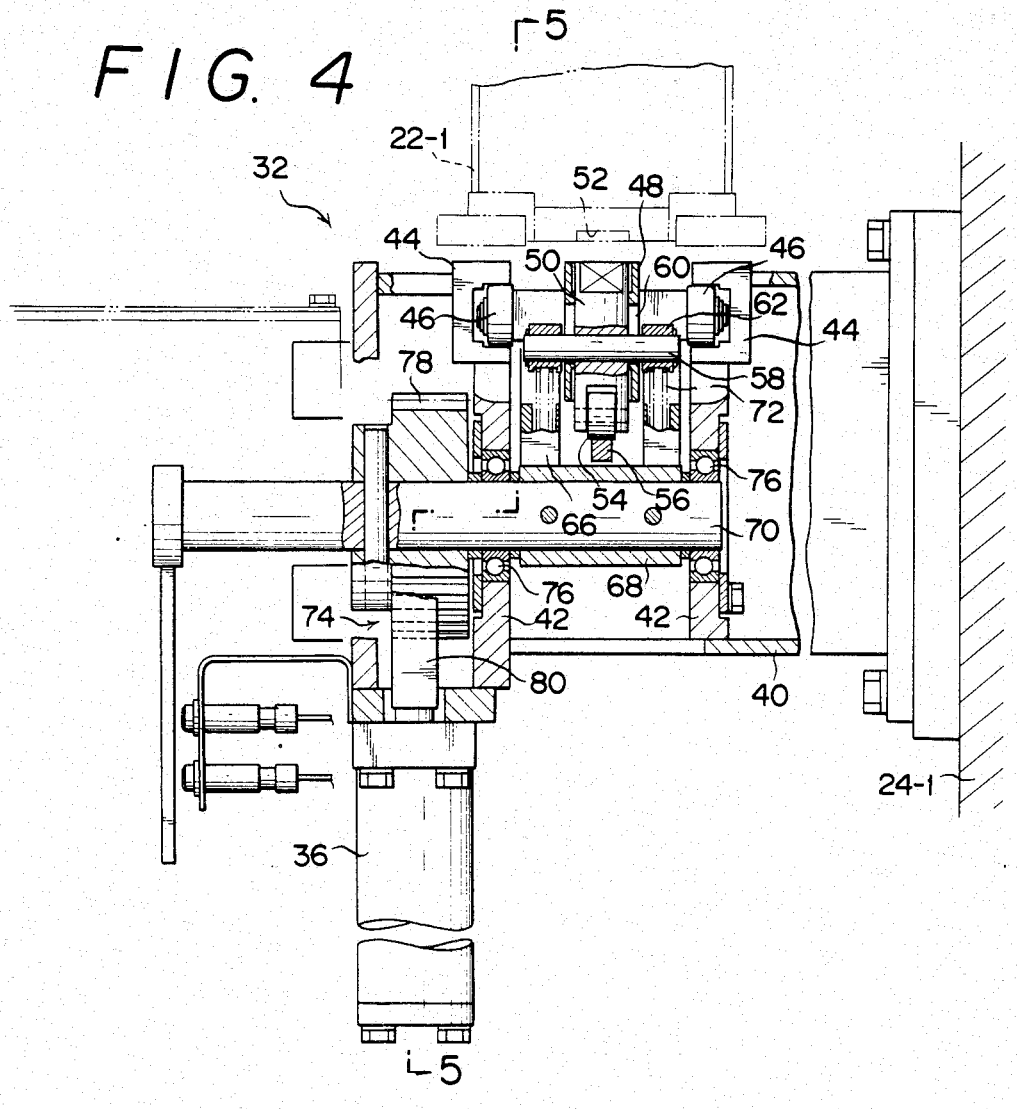
FIG. 4 is a vertical section through the one-way splitting mechanism of FIG. 3.
Figure 5:
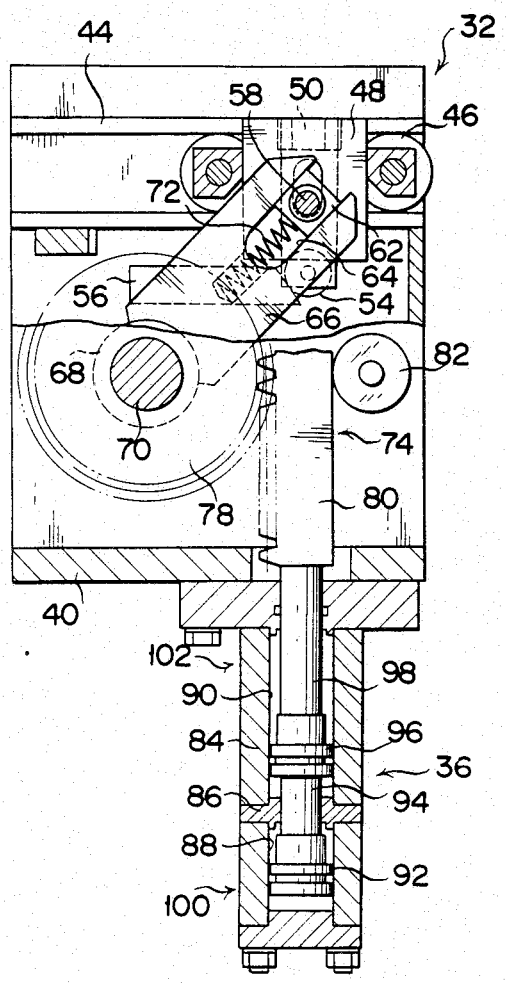
FIG. 5 is a section through the one-way splitting mechanism, taken along the line 5—5 of FIG. 4.
Figure 6:
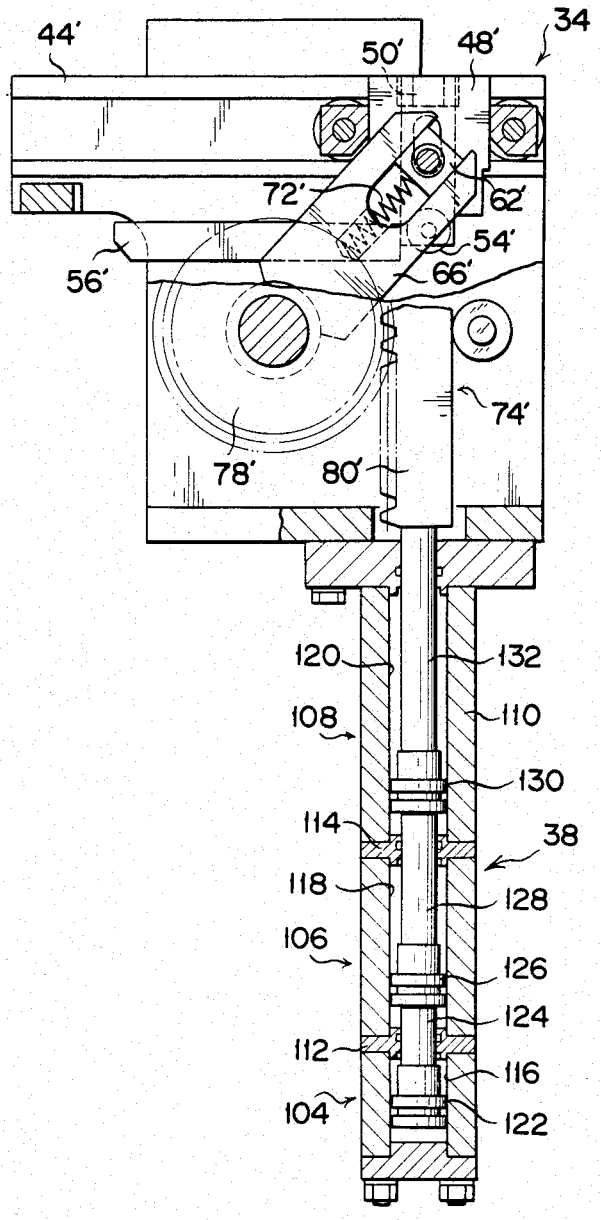
FIG. 6 is a view corresponding to FIG. 5 but showing one of the two-way splitting mechanisms used in the transfer press of FIGS. 1 and 2.

FIGS. 3, 4 and 5 illustrate in detail the one-way splitting mechanism 32, and FIG. 6 the two-way splitting mechanism 34. A detailed discussion of the one-way splitting mechanism 32 will be given first, followed by a brief description of the two-way splitting mechanism 34 as to its differences from the one-way splitting mechanism.

The one-way splitting mechanism 32 has a generally boxlike housing or support structure 40 rigidly anchored to that surface of one of the first pair of uprights 24-1 which is opposed to the other upright of that pair. The housing 40 has a pair of vertical bearing walls 42 firmly mounted therein. Supported atop the bearing walls 42 are a pair of channeled guides 44 extending horizontally in parallel spaced relation to each other just under the terminal transfer bar segment 22-1. These guides 44 have their channels held opposite to each other. Rollably engaged in the channeled guides 44 are two pairs of rollers or wheels 46 conjointly supporting a carriage 48 lying centrally between the guides and under the terminal transfer bar segment 22-1. The carriage 48 is of course rollable back and forth along the guides 44.

A splitter pin 50 is mounted to the carriage 48 for up and down sliding motion relative to the same and for joint hoizontal travel therewith along the guides 44. On its upward displacement the splitter pin 50 is engageable in a recess 52, FIG. 4, cut in the bottom of the terminal transfer bar segment 22-1 and thus becomes movable therewith along the guides 44. A cam follower roller 54 is rotatably mounted on the bottom end of the splitter pin 50 so as to partly project downwardly therefrom to ride on a horizontally elongated cam 56 parallel to the guides 44. This cam functions to hold the splitter pin 50 in engagement with the terminal transfer bar segment 22-1 during its travel with the carriage 48 along the guides 44.

A horizontal spindle 58 is affixed to the splitter pin 50, at a point midway between its ends, so as to project therefrom in its opposite lateral directions through vertical slots 60 defined in the carriage 48. Rotatably mounted on these projecting ends of the spindle 58 are a pair of square shaped sliders 62 which are slidably engaged respectively in guide slots 64 in a pair of levers 66. These levers are both rigidly mounted each at one end on a sleeve 68 nonrotatably fitted over a drive shaft 70 extending horizontally under and across the guides 44. Each guide slot 64 extends from the distal end of one lever 66 in its longitudinal direction and terminates short of its proximal end. A helical compression spring 72 acts between each lever 66 and the corresponding slider 62 to bias the latter toward the distal end of the lever.

Thus the pivotal motion of the levers 66 results in the up and down motion of the splitter pin 50 relative to the carriage 48 and in the horizontal travel of the splitter pin with the carriage along the guides 44. It will be seen that the provision of only one slider 62 and one lever 66 suffices to cause such movements of the splitter pin. However, the arrangement of the pair of sliders and pair of levers on both sides of the carriage 48 as in the illustrated embodiment is preferred.

For the desired pivotal motion of the levers 66 and therefore the bidirectional rotation of the drive shaft 70 there are provided a rack and pinion mechanism 74 and the aforesaid dual cylinder assembly 36. The drive shaft 70 is rotatably supported by the upstanding walls 42 of the support structure 40 via bearings 76. Fixedly mounted on this drive shaft is a pinion 78 in mesh with an upright rack 80 moved up and down by the dual cylinder assembly 36. A roll 82 holds the rack 80 in positive engagement with the pinion 78.

As drawn in an axial section in FIG. 5, the dual cylinder assembly 36 has a cylindrical housing 84 fastened to and depending from the bottom of the support structure 40. A partition 86 divides the interior of the housing 84 into a first or lower fluid chamber 88 and a second or upper fluid chamber 90. Slidably mounted in the lower fluid chamber 88 is a first piston 92 having a first piston rod 94 slidably extending through the partition 86 into the upper fluid chamber 90. The upper fluid chamber 90 has a second piston 96 slidably mounted therein for movement into and out of abutment against the first piston rod 94. The second piston 96 has a second piston rod 98 extending upwardly therefrom and projecting out of the housing 84. The projecting end of the second piston rod 98 has the rack 80 rigidly mounted thereon.

Thus, in essence, the dual cylinder assembly 36 is a series connection of a first or lower fluid actuated cylinder 100 and a second or upper fluid actuated clyinder 102. The piston 92 of the lower cylinder 100 has a shorter stroke than that of the piston 96 of the upper cylinder 102.

An inspection of FIG. 6 will reveal that, except for the triple cylinder assembly 38, the two-way splitting mechanism 34 illustrated therein is substantially identical in construction with the one-way splitting mechanism 32 of FIGS. 3 through 5. Accordingly the foregoing description of the one-way splitting mechanism 32 exclusive of the dual cylinder assembly 36 applies to the two-way splitting mechanism 34 exclusive of the triple cylinder assembly 38. In the two-way splitting mechanism 34, however, a pair of channeled guides 44' and a cam 56' are both made longer than their counterparts in the one-way splitting mechanism 32 to accommodate a longer horizontal stroke of a carriage 48' having a splitter pin 50' slidably mounted thereon for up and down motion.

Some additional parts of the two-way splitting mechanism 34 are identified in FIG. 6 by priming the reference numerals used to denote the corresponding parts of the one-way splitting mechanism. Such parts designated by the primed reference numerals will be referred to in the course of the subsequent description of operation.

The triple cylinder assembly 38 of the two-way splitting mechanism 34 may be described as a serial combination of a first or lower fluid actuated cylinder 104, a second or middle fluid actuated cylinder 106, and a third or upper fluid actuated cylinder 108. More specifically the triple cylinder assembly 38 has an upstanding common cylindrical housing 110 having two partitions 112 and 114 dividing its interior into lower 116, middle 118 and upper 120 fluid chambers. The lower fluid chamber 116 has slidably mounted therein a first piston 122 having a first piston rod 124 slidably extending through the partition 112 into the middle fluid chamber 118. The middle fluid chamber 118 has a second piston 126 slidably mounted therein for movement into and out of abutment against the first piston rod 124. The second piston 126 has a second piston rod 128 slidably extending through the partition 114 into the upper fluid chamber 120. A third piston 130 is slidably mounted in the upper fluid chamber 120 for movement into and out of abutment against the second piston rod 128. A third piston rod 132 extends from the third piston 130 and projects out of the housing 110 to be coupled to a rack 80' of a rack and pinion mechanism 74'.

In the triple cylinder assembly 38 of the foregoing construction the strokes of the three pistons 122, 126 and 130 become progressively longer from the first piston 122 toward the third piston 130.

Figure 7A:
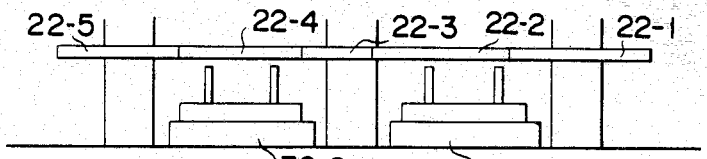
FIGS. 7A through 7I are a series of diagrammatic side elevations of the transfer press of FIGS. 1 and 2 explanatory of the way in which each transfer bar is split into the five segments, and then the segments are recombined into a transfer bar, by the one-way and two-way splitting mechanisms.
Figure 7B:
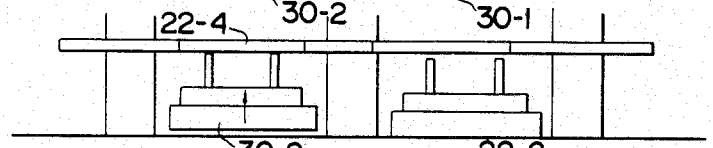
Figure 7C:
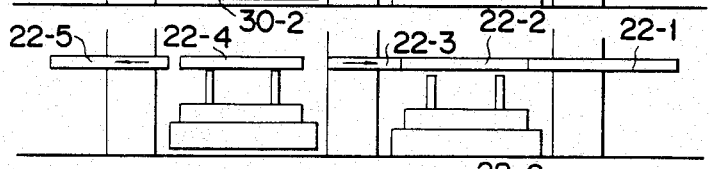

FIGS. 7A through 7E illustrate the sequential steps of splitting each transfer bar 22 of the transfer press 20 into the five segments 22-1 through 22-5. As has been mentioned, all these transfer bar segments are joined end to end by the couplings 26 during normal work indexing operation as in FIG. 7A. For die change the second die bolster 30-2 may first be lifted to hold the fourth bar segment 22-4 thereon as in FIG. 7B. Then, with the third to fifth bar segments 22-3 through 22-5 disengaged from each other by releasing the couplings 26, the fifth bar segment 22-5 is moved leftwardly, apart from the fourth bar segment 22-4, by the multiple drive mechanism 28 of the transfer press 20 as in FIG. 7C. Also as depicted in FIG. 7C, the third bar segment 22-3 is moved rightwardly together with the first 22-1 and second 22-2 bar segments apart from the fourth bar segment 22-4 by the two-way splitting mechanism 34.

The following is the discussion of the operation of the two-way splitting mechanism 34 in moving the third bar segment 22-3 away from the fourth 22-4 as above.

Figure 8A:
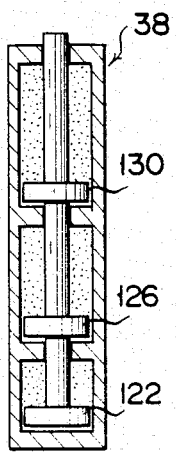
FIGS. 8A through 8D are a series of axial sections of the triple cylinder assembly of the two-way splitting mechanism which are explanatory of its operation.
Figure 8B:
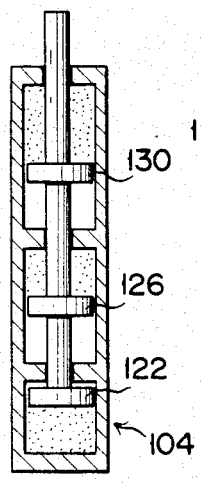

All the pistons 122, 126 and 130 of the triple cylinder assembly 38 of the two-way splitting mechanism 34 are held lowered as in FIG. 8A when the two-way splitting mechanism is inoperative. Pressurized fluid is first delivered to the lower fluid chamber of the lower cylinder 104 of the triple cylinder assembly 38, as in FIG. 8B, thereby causing the full ascent of the first piston 122 together with the second 126 and third 130 pistons. Thereupon the rack 80', FIG. 6, of the rack and pinion mechanism 74' rises to cause the pinion 78' to turn a preassigned angle in a counterclockwise direction together with the pair of levers 66'. This counterclockwise turn of the levers 66' results in the upward displacement of the sliders 62' over a distance of, say, 20 millimeters under the influence of the compression springs 72'. Thus the splitter pin 50' moves upwardly relative to the carriage 48' into engagement in a recess (similar to the one pictured at 52 in FIG. 4) in the third bar segment 22-3.

Figure 8C:
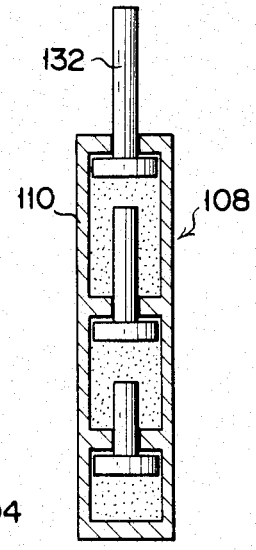

Then, as indicated in FIG. 8C, pressurized fluid is delivered to the lower fluid chamber of the upper cylinder 108 of the triple cylinder assembly 38 thereby causing the third piston rod 132 to project further from the housing 110. This results in the further counterclockwise turn of the levers 60' and, in consequence, in the horizontal travel of the splitter pin 50' together with the carriage 48' along the guides 44' over a distance of, say, 200 millimeters. Now, as in FIG. 7C, the third bar segment 22-3 travels the same distance to the right together with the first 22-1 and second 22-2 bar segments away from the fourth bar segment 22-4. During such horizontal travel of the splitter pin 50' the cam follower roller 54' on its bottom end rides over the cam 56' to maintain the splitter pin in positive engagement with the third bar segment 22-3.

Figure 7D:
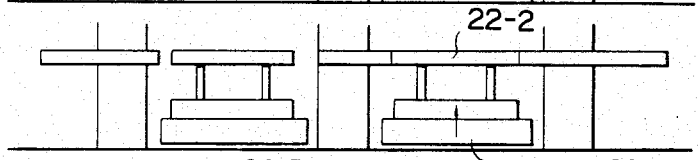
Figure 7E:
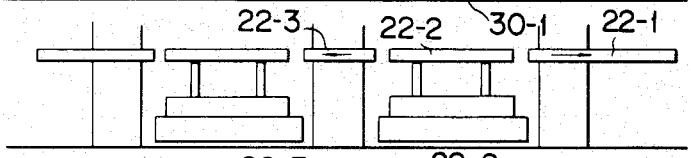

Then the first die bolster 30-1 is raised into engagement with the second bar segment 22-2 as in FIG. 7D.

Figure 8D:
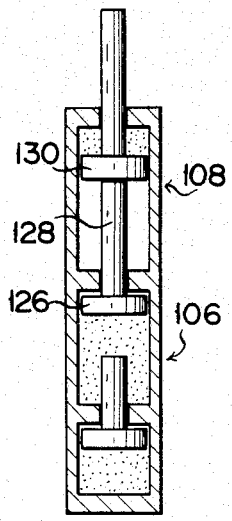

Thereafter, as depicted in FIG. 8D, pressurized fluid is delivered both to the upper chamber of the upper cylinder 108, and to the lower chamber of the middle cylinder 106, of the triple cylinder assembly 38. The result is the descent of the third piston 130 into abutment on the piston rod 128 of the second piston 126 in its raised position, with the consequent turn of the levers 66' in a clockwise direction as viewed in FIG. 6. The splitter pin 50' returns with the carriage 48' along the guides 44' over a distance of, say, 100 millimeters. Accordingly the third bar segment 22-3 becomes separated from the second bar segment 22-2 as in FIG. 7E.

Figure 9A:
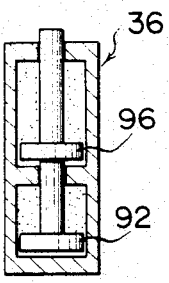
FIGS. 9A through 9C are a series of axial sections of the dual cylinder assembly of the one-way splitting mechanism which are explanatory of its operation.
Figure 9B:
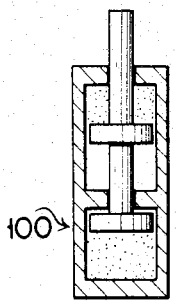
Figure 9C:
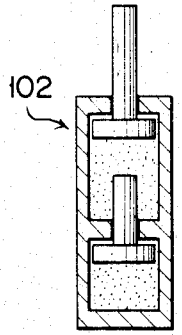

Concurrently with the above activation of the triple cylinder assembly 38, pressurized fluid is delivered to the lower chamber of the lower cylinder 100 of the dual cylinder assembly 36 of the one-way splitting mechanism 32, as illustrated in FIG. 9B. Both pistons 92 and 96 of this dual cylinder assembly have been held lowered as in FIG. 9A. The delivery of the pressurized fluid to the lower chamber of the lower cylinder 100 results in the upward displacement of the rack 80, FIG. 5, and hence of the splitter pin 50 to an extent necessary for engagement in the recess 52, FIG. 4, in the first bar segment 22-1. Then, as in FIG. 9C, pressurized fluid is further delivered to the lower chamber of the upper cylinder 102 of the dual cylinder assembly 36 thereby causing the splitter pin 50 to travel horizontally with the carriage 48 along the guides 44 over a distance of, say, 100 millimeters. Thus the first bar segment 22-1 travels to the right, as in FIG. 7E, away from the second bar segment 22-2.

Now is completed the splitting of the exemplified transfer bar 22, together with the other transfer bar. The second 22-2 and fourth 22-4 pairs of bar segments may be withdrawn from the transfer press 20 together with the respective die bolsters 30-1 and 30-2.

Figure 7F:
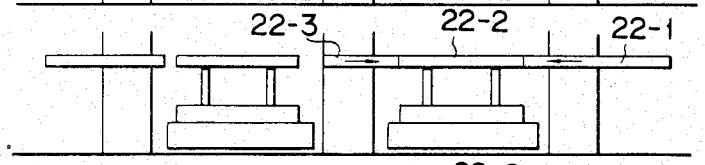
Figure 7G:
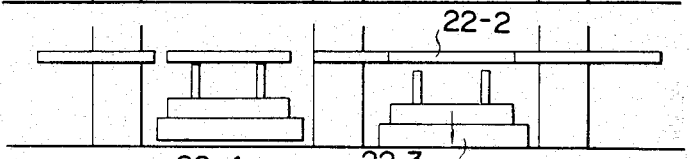
Figure 7H:
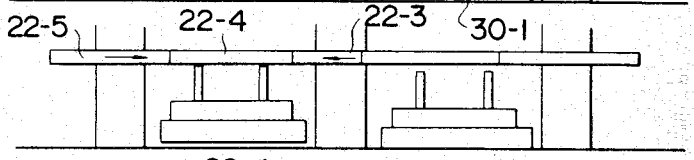
Figure 7I:
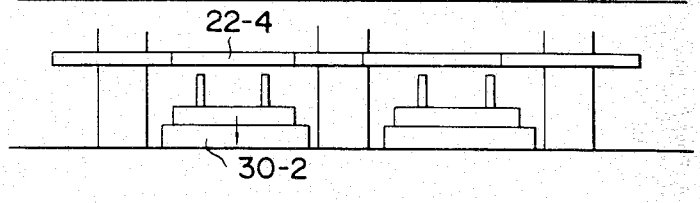

The above splitting procedure may be reversed for reuniting the segments 22-1 through 22-5 of each transfer bar 22. First, as shown in FIG. 7F, the first 22-1 and third 22-3 bar segments are recombined with the second bar segment 22-2. Then the first die bolster 30-1 is lowered out of engagement with the second bar segment 22-2 as in FIG. 7G. Then the third 22-3 and fifth 22-5 bar segments are recombined with the fourth bar segment 22-4 as in FIG. 7H. Then the second die bolster 30-2 is lowered out of engagement with the fourth bar segment 22-4.

Second Form

Figure 10:
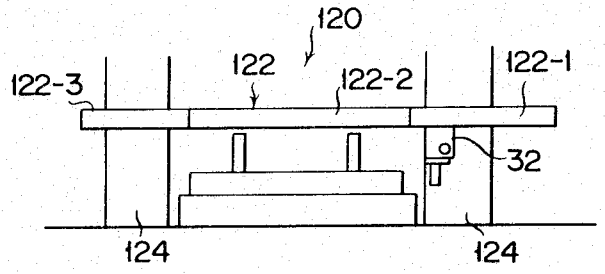
FIG. 10 is a diagrammatic side elevation of another example of transfer press having a pair of three-segment transfer bars to be split in accordance with the invention.

The one-way and two-way splitting mechanisms in accordance with the invention lend themselves to use with transfer bars having smaller or greater numbers of segments than five. Thus, in FIG. 10, the one-way splitting mechanism 32 is shown together with a transfer press 120 having a pair of three-segment transfer bars 122 and two opposed pairs of uprights 124. Each transfer bar consists of a right hand terminal segment 122-1, a central segment 122-2, and a left hand terminal segment 122-3.

Positioned under the right hand terminal segment 122-1 of each transfer bar 122, the one-way splitting mechanism 32 is used for separating the same from the central segment 122-2. The left hand terminal segment 122-3 can be separated from the central segment 122-2 either by the multiple drive mechanism of the transfer press, similar to the one designated 28 in FIGS. 1 and 2, or by another one-way splitting mechanism. Further details of this second embodiment are considered self-evident from the foregoing description of the first embodiment.

Third Form

Figure 11:
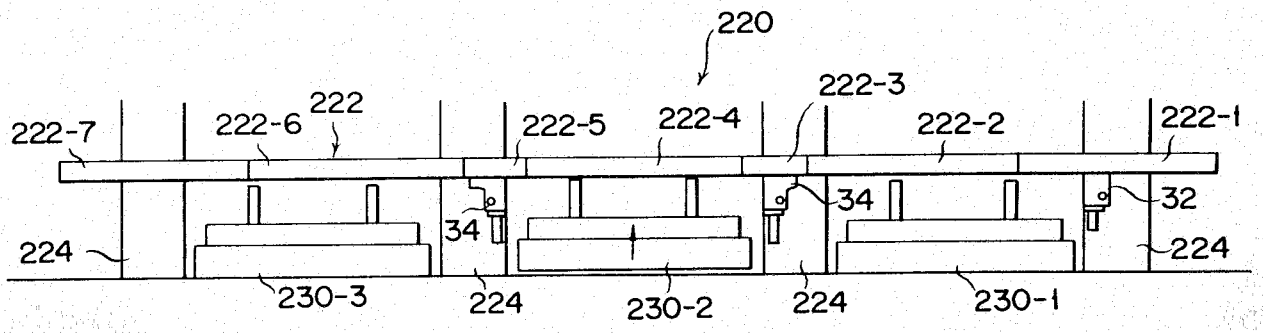
FIG. 11 is a diagrammatic side elevation of still another example of transfer press having a pair of seven-segment transfer bars to be split in accordance with the invention.

FIG. 11 is an illustration of a further example of transfer press 220 having a pair of seven-segment transfer bars 222 and four opposed pairs of uprights 224. In this application one one-way splitting mechanism 32 is mounted under the first segment 222-1 of each transfer bar 222 at the work entrance end of the press, and two two-way splitting mechanisms 34 are mounted under the third 222-3 and fifth 222-5 segments, respectively, of each transfer bar 222. The second 222-2, fourth 222-4 and sixth 222-6 bar segments overlie first 230-1, second 230-2 and third 230-3 die bolsters, respectively.

Figures 12A, 12B, 12C, 12D, 12E, 12F:
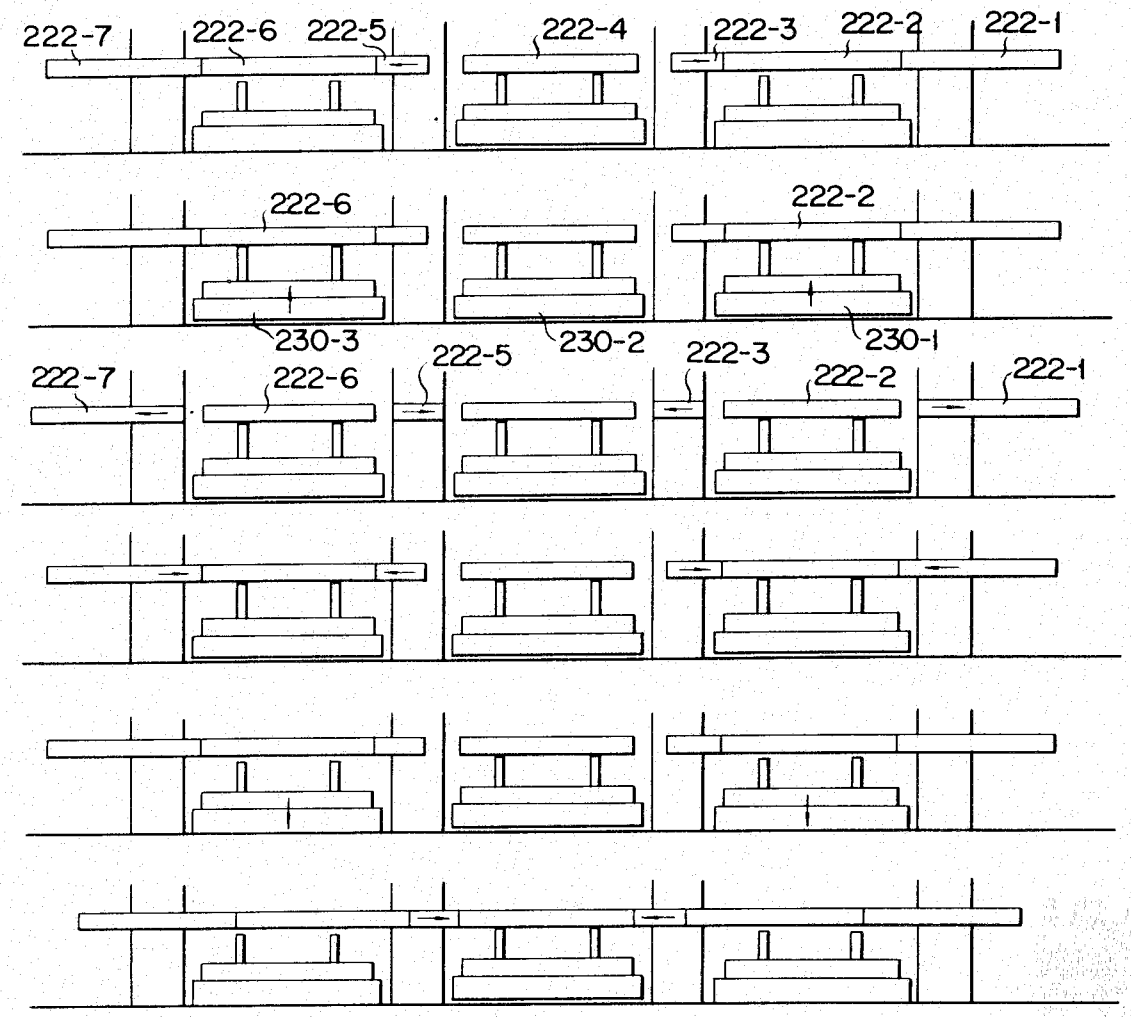
FIGS. 12A through 12F are a series of diagrammatic side elevations of the transfer press of FIG. 11 explanatory of the way in which each transfer bar is split into the seven segments, and then the segments are recombined into a transfer bar, by the one-way and two-way splitting mechanisms of this invention.

For splitting each transfer bar 222 into the seven segments the second die bolster 230-2 may first be raised into engagement with the fourth bar segment 222-4 as in FIG. 11. Then the two two-way splitting mechanisms 34 are activated to move the first 222-1 to third 222-3 bar segments rightwardly, and the fifth 222-5 to seventh 222-7 bar segments leftwardly, away from the fourth bar segment 222-4 as in FIG. 12A. FIG. 12B shows the first 230-1 and third 230-3 die bolsters subsequently raised into engagement with the second 222-2 and sixth 222-6 bar segments respectively. Then, as in FIG. 12C, the two two-way splitting mechanisms 34 are reactivated to move the third 222-3 and fifth 222-5 bar segments in the opposite directions away from the second 222-2 and sixth 222-6 bar segments respectively. Further the first bar segment 222-1 is separated from the second bar segment 222-2 by the one-way splitting mechanism, and the seventh bar segment 222-7 is separated from the sixth bar segment 222-6 by the multiple drive mechanism of the transfer press 220.

The representative transfer bar 222 has now been split up into the seven segments 222-1 through 222-7. It will be understood, then, that the bar segments can be reunited by following the procedure of FIGS. 12D through 12F.

A variety of modifications and variations of the above disclosed embodiments will be readily recognized by those skilled in the art to conform to the specific requirements of the applications of the invention or to design preferences, without departing from the scope of the invention.

What is claimed is:

1. In apparatus having a pair of transfer bars extending in parallel spaced relationship to each other for indexing work through one or more processing stations, each transfer bar having a plurality of segments separably joined together, a splitting mechanism for longitudinally separating one transfer bar segment away from another, comprising:

(a) guide means extending longitudinally of one transfer bar;

(b) a carriage disposed under one of the segments of the transfer bar and movable along the guide means;

(c) a splitter pin mounted to the carriage for up and down motion relative to the same and for joint movement therewith along the guide means, the splitter pin when moved upwardly being engageable with the one transfer bar segment for joint movement therewith along the guide means;

(d) at least one slider mounted to the splitter pin for joint up and down motion therewith relative to the carriage and for joint movement with the splitter pin and the carriage along the guide means;

(e) a lever supported under the guide means for pivotal motion about a fixed axis, the lever having a guide slot defined longitudinally therein for receiving the slider so as to allow longitudinal sliding motion thereof;

(f) resilient means acting between the slider and the lever for biasing the slider away from the fixed axis of the lever, whereby the splitter pin is movable up and down relative to the carriage and further movable therewith along the guide means with the pivotal motion of the lever;

(g) a rack and pinion mechanism for causing the pivotal motion of the lever;

(h) a multiple cylinder assemly acting on the rack and pinion mechanism for causing the same to pivot the lever in a controlled manner; and (i) cam means for holding the splitter pin in engagement with the transfer bar segment during the travel of the splitter pin along the guide means.

2. The invention of claim 1 wherein the multiple cylinder assembly comprises:

(a) a housing;

(b) a partition in the housing dividing the interior thereof into first and second fluid chambers;

(c) a first piston slidably mounted in the first fluid chamber;

(d) a first piston rod secured at one end to the first piston and slidably extending through the partition into the second fluid chamber;

(e) a second piston slidably mounted in the second fluid chamber for movement into and out of abutment against the first piston rod; and (f) a second piston rod secured at one end to the second piston and extending therefrom in a direction away from the first piston, the second piston rod projecting out of the housing for acting on the rack and pinion mechanism.

3. In apparatus having a pair of transfer bars extending in parallel spaced relationship to each other for indexing work through a series of processing stations, each transfer bar having a plurality of segments separably coupled together, a device for longitudinally splitting each transfer bar into the constitutent segments thereof, comprising:

(a) a one-way splitting mechanism for separating a terminal segment of one transfer bar from the next, comprising:

(1) first guide means extending along the terminal segment of the transfer bar;

(2) a first carriage disposed under the terminal segment of the transfer bar and movable along the first guide means;

(3) a first splitter pin mounted to the first carriage for up and down motion relative to the same and for joint movement therewith along the first guide means, the first splitter pin when moved upwardly being engageable with the terminal transfer bar segment for joint movement therewith along the first guide means;

(4) at least one first slider mounted to the first splitter pin for joint up and down motion therewith relative to the first carriage and for joint movement with the first splitter pin and the first carriage along the first guide means;

(5) a first lever supported under the first guide means for pivotal motion about a fixed axis, the first lever having a guide slot defined longitudinally therein for receiving the first slider so as to allow longitudinal sliding motion thereof;

(6) first resilient means acting between the first slider and the first lever for biasing the first slider away from the fixed axis of the first lever, whereby the first splitter pin is movable up and down relative to the first carriage and further movable therewith along the first guide means with the pivotal motion of the first lever;

(7) a first rack and pinion mechanism for causing the pivotal motion of the first lever;

(8) a first multiple cylinder assembly acting on the first rack and pinion mechanism for causing the same to pivot the first lever in such a way that the first splitter pin is moved into engagement with the terminal transfer bar segment and moved therewith away from the next transfer bar segment; and (9) first cam means for holding the first splitter pin in engagement with the terminal transfer bar segment during the travel of the first splitter pin along the first guide means;

(b) and a two-way splitting mechanism for separating a central segment of one transfer bar away from the oppositely adjoining segments, comprising:

(1) second guide means extending along the central transfer bar segment;

(2) a second carriage disposed under the central transfer bar segment and movable along the second guide means;

(3) a second splitter pin mounted to the second carriage for up and down motion relative to the same and for joint movement therewith along the second guide means, the second splitter pin when moved upwardly being engageable with the central transfer bar segment for joint movement therewith along the second guide means;

(4) at least one second slider mounted to the second splitter pin for joint up and down motion therewith relative to the second carriage and for joint movement with the second splitter pin and the second carriage along the second guide means;

(5) a second lever supported under the second guide means for pivotal motion about a fixed axis, the second lever having a guide slot defined longitudinally therein for receiving the second slider so as to allow longitudinal sliding motion thereof;

(6) second resilient means acting between the second slider and the second lever for biasing the second slider away from the fixed axis of the second lever, whereby the second splitter pin is movable up and down relative to the second carriage and further movable therewith along the second guide means with the pivotal motion of the second lever;

(7) a second rack and pinion mechanism for causing the pivotal motion of the second lever;

(8) a second multiple cylinder assembly acting on the second rack and pinion mechanism for causing the same to pivot the second lever in such a way that the second splitter pin is moved into engagement with the central transfer bar segment and moved bidirectionally therewith along the second guide means so as to separate the central transfer bar segment from the oppositely adjoining transfer bar segments; and (9) second cam means for holding the second splitter pin in engagement with the central transfer bar segment during the bidirectional travel of the second splitter pin along the second guide means.

4. The invention of claim 3 wherein the first multiple cylinder assembly comprises:

(a) a housing:

(b) a partition in the housing dividing the interior thereof into first and second fluid chambers;

(c) a first piston slidably mounted in the first fluid chamber and having a first piston rod slidably extending through the partition into the second fluid chamber; and (d) a second piston slidably mounted in the second fluid chamber for movement into and out of abutment against the first piston rod and having a second piston rod extending therefrom in a direction away from the first piston, the second piston rod projecting out of the housing for acting on the first rack and pinion mechanism.

5. The invention of claim 4 wherein the first piston has a shorter stroke than that of the second piston.

6. The invention of claim 3 wherein the second multiple cylinder assembly comprises:

(a) a housing;

(b) first and second partitions in the housing dividing the interior thereof into first, second and third fluid chambers;

(c) a first piston slidably mounted in the first fluid chamber and having a first piston rod slidably extending through the first partition into the second fluid chamber;

(d) a second piston slidably mounted in the second fluid chamber for movement into and out of abutment against the first piston rod and having a second piston rod slidably extending through the second partition into the third fluid chamber; and (e) a third piston slidably mounted in the third fluid chamber for movement into and out of abutment against the second piston rod and having a third piston rod projecting out of the housing for acting on the second rack and pinion mechanism.

7. The invention of claim 6 wherein the strokes of the three pistons of the second multiple cylinder assembly become progressively longer from the first piston toward the third piston.

* * * * *